US009653241B2

(12) United States Patent
Boffelli et al.

(10) Patent No.: US 9,653,241 B2
(45) Date of Patent: May 16, 2017

(54) MAGNETIC ACTUATING DEVICE FOR A CURRENT SWITCHING DEVICE

(71) Applicant: ABB Technology AG, Zurich (CH)

(72) Inventors: Carlo Boffelli, Dalmine (Bergamo) (IT); Manuel Gotti, Turgi Aargau (CH); Michele Romeo Rizzi, Mozzo (Bergamo) (IT)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 14/772,410

(22) PCT Filed: Mar. 18, 2013

(86) PCT No.: PCT/EP2013/055549

§ 371 (c)(1),
(2) Date: Sep. 3, 2015

(87) PCT Pub. No.: WO2014/146678

PCT Pub. Date: Sep. 25, 2014

(65) Prior Publication Data

US 2016/0012994 A1 Jan. 14, 2016

(51) Int. Cl.

| | |
|---|---|
| ***H01H 33/34*** | (2006.01) |
| ***H01H 50/32*** | (2006.01) |
| ***H01H 33/666*** | (2006.01) |

(52) U.S. Cl.

CPC ..... *H01H 50/32* (2013.01); *H01H 33/666* (2013.01)

(58) Field of Classification Search

CPC ..... H01H 33/666

(Continued)

(56) References Cited

U.S. PATENT DOCUMENTS 5,523,536 A * 6/1996 Binder ..... H01H 33/666 218/120
6,852,939 B2 * 2/2005 Rhein ..... H01H 33/6662 218/120

(Continued)

FOREIGN PATENT DOCUMENTS

| | | |
|---|---|---|
| DE | 8715295 U1 | 1/1988 |
| DE | 9213142 U1 | 2/1993 |
| WO | 9408348 | 4/1994 |

OTHER PUBLICATIONS

International Search Report and Written Opinion in PCT/EP2013/055549 dated Dec. 16, 2013.

(Continued)

*Primary Examiner* — Alexander Talpalatski
(74) *Attorney, Agent, or Firm* — Manelli Selter PLLC; Edward J. Stemberger

(57) ABSTRACT

A magnetic actuating device (1) for a current switching device (2) comprises: —a ferromagnetic stator (3) and a ferromagnetic armature (4) which is movable between a first end position (5), which is close to the ferromagnetic stator (3), and a second end position (6) which is spaced apart from the ferromagnetic stator (3), —a compression spring (7)configured for urging the ferromagnetic armature (4) to the second end position (6), —an electrical coil (8) energizable for electromagnetically attracting the ferromagnetic armature (4) to the first end position (5), and —a mechanical locking assembly (10) configured for releasably blocking the ferromagnetic armature (4) in the first end position (5).

15 Claims, 7 Drawing Sheets

(58) Field of Classification Search
USPC ..... 218/120, 154; 335/167–168
See application file for complete search history.

(56) References Cited

U.S. PATENT DOCUMENTS

| | | | | |
|---|---|---|---|---|
| 7,545,245 | B2 * | 6/2009 | Zhou | H01H 3/227 200/18 |
| 7,843,293 | B1 * | 11/2010 | Bonjean | H01H 3/28 218/154 |
| 8,247,725 | B2 * | 8/2012 | Morita | H01H 33/66207 218/120 |
| 8,629,366 | B2 * | 1/2014 | Reuber | H01H 33/66207 218/44 |
| 9,053,882 | B2 * | 6/2015 | Reuber | H01H 33/38 |
| 9,368,294 | B2 * | 6/2016 | Ohtsuka | H01F 7/124 |
| 2001/0017288 | A1 * | 8/2001 | Morita | H01H 33/666 218/154 |
| 2007/0252599 | A1 * | 11/2007 | Zhou | H01H 9/563 324/424 |
| 2013/0214886 | A1 * | 8/2013 | Ohtsuka | H01F 7/124 335/189 |

OTHER PUBLICATIONS

Office Action in corresponding CN application No. 201380074834.0 dated Jan. 13, 2017.

* cited by examiner

MAGNETIC ACTUATING DEVICE FOR A CURRENT SWITCHING DEVICE

The present invention relates to a magnetic actuating device suitable for being connected to a current switching device, such as a circuit-breaker, for switching on/off an electrical apparatus.

The electrical opening/closing manoeuvres of a medium-voltage circuit breaker are normally carried out by a magnetic actuator. The magnetic actuators currently used on medium-voltage circuit breakers can be of a so called "bi-stable" type or of a "mono-stable" type.

The bi-stable actuator comprise a ferromagnetic armature which is movable relative to a ferromagnetic stator along a longitudinal axis and between a first end position, corresponding to a closing condition of the circuit breaker, and a second end position, corresponding to an opening condition of the circuit breaker. The bi-stable actuator comprises a first electrical coil and a second electrical coil mutually axially spaced, each electrical coil extending around the above-mentioned longitudinal axis, and a pair of stationary permanent magnets arranged at the sides of the ferromagnetic armature and interposed between the two electrical coils. There are provided one or more electrolytic capacitors which intervene for energizing the first or second electrical coil when a closing or opening respectively of the circuit breaker is required.

The bi-stable actuator is so designed as to generate two distinct magnetic circuits which alternately are closed and opened depending on which of the two coils is energized and consequently according to the occurrence or disappearance of a proper air gap between the ferromagnetic armature, the ferromagnetic stator and respective coil. By energizing the first electrical coil, a magnetic field is generated which attracts the armature to the first end position thus reducing the air gap and closing the respective magnetic circuit.

Consequently, the permanent magnets lock the ferromagnetic armature in the reached first end position thus keeping the circuit breaker stably in the closing condition. When an opening of the circuit breaker is required, the ferromagnetic armature must be transferred from the first end position to the second end position and therefore the second electrical coil must be energized. The total force necessary to displace the ferromagnetic armature has to overcome the attraction force exerted by the two permanent magnets and, in addition, the force opposed by the movable contacts of the circuit breaker. This implies that a relevant electrical energy stored in the electrolytic capacitors is required.

A mono-stable actuator is configured analogously to the bi-stable actuator but differs therefrom by comprising a single electrical coil which operates for attracting the ferromagnetic armature to the first end position in order to close the circuit breaker. The presence of two permanent magnets ensures a stable position of the ferromagnetic armature in the first end position. The mono-stable actuator further comprises a compression spring which urges the ferromagnetic armature towards the second end position corresponding to the opening condition of the circuit breaker, and a lower ferromagnetic disk integral with the plunger and arranged opposite to the ferromagnetic armature with respect to the permanent magnets. In the opening condition of the circuit breaker, the ferromagnetic armature is spaced apart from the electrical coil, and the ferromagnetic disk is in contact with the permanent magnets under the magnetic force exerted thereby. In this condition an air gap is defined between the ferromagnetic armature and the electrical coil.

When closing of the circuit breaker should be achieved, the electrical coil is energized thus generating a magnetic field which attracts the ferromagnetic armature to the first end position, while the ferromagnetic disk is moved away from the permanent magnets. The energy required by the electrical coil for moving the ferromagnetic armature must be sufficiently high to overcome the compression spring and the resistance force opposed by the circuit breaker. Subsequently, the ferromagnetic armature is kept stably in the first end position by the permanent magnets. When for safety reasons an opening of the circuit breaker is required, for example because of a fault, the electrical coil must be energized for generating such a magnetic field as to weaken or annul the attraction magnetic force acting on the ferromagnetic armature by the permanent magnets. For this purpose, a relevant electrical energy stored in the electrolytic capacitors is required.

A drawback common to the known mono-stable and bi-stable actuator above described is that the electrolytic capacitors, if not kept constantly charged, get discharged during the time. When the electrolytic capacitors run down, some difficulties in opening the circuit breaker occur. Even more, if auxiliary power is not available, and the residual charge of capacitors is not enough to drive the ferromagnetic armature, the circuit breaker cannot be opened.

It is desirable to improve the known magnetic actuators, in particular by providing a magnetic actuating device which, through a cheap and simple technical solution, ensures a reliable and effective driving of a circuit breaker with a very reduced amount of energy required.

This is achieved by a magnetic actuating device as defined in the appended claims and described hereinafter in details.

Owing to the claimed magnetic actuating device, a very reduced energy is sufficient to open a circuit breaker, and no expensive permanent magnets are necessary for holding the magnetic actuating device in a desired condition, in particular in a locking configuration corresponding to a closed status of the circuit breaker.

The present disclosure encompasses also a current switching device, in particular a circuit breaker, comprising the magnetic actuating device, and a switchgear, equivalently called with the term panel or cabinet or switchboard, including such a current switching device and the magnetic actuating device associated therewith.

Characteristics and advantages of the present disclosure will result from the description and from claims.

The present disclosure can be better understood and implemented with reference to the attached drawings that illustrate an embodiment thereof by way of non-limiting examples, in which.

Figure 2:
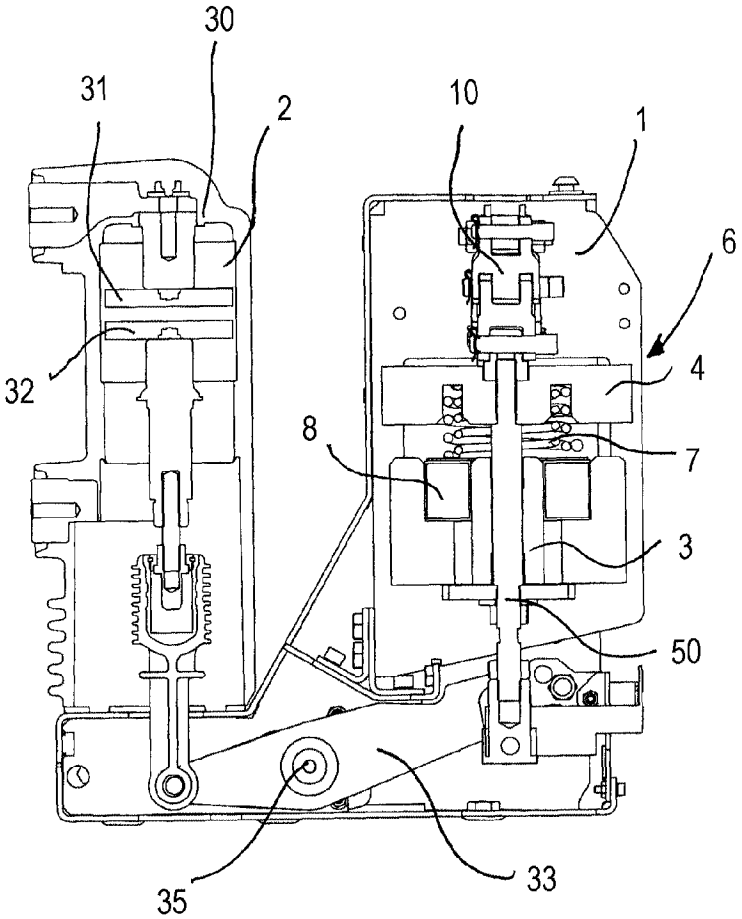
FIG. 2 is a section view of FIG. 1 taken along the plane II-II, showing the magnetic actuating device connected to a circuit breaker.
Figure 1:
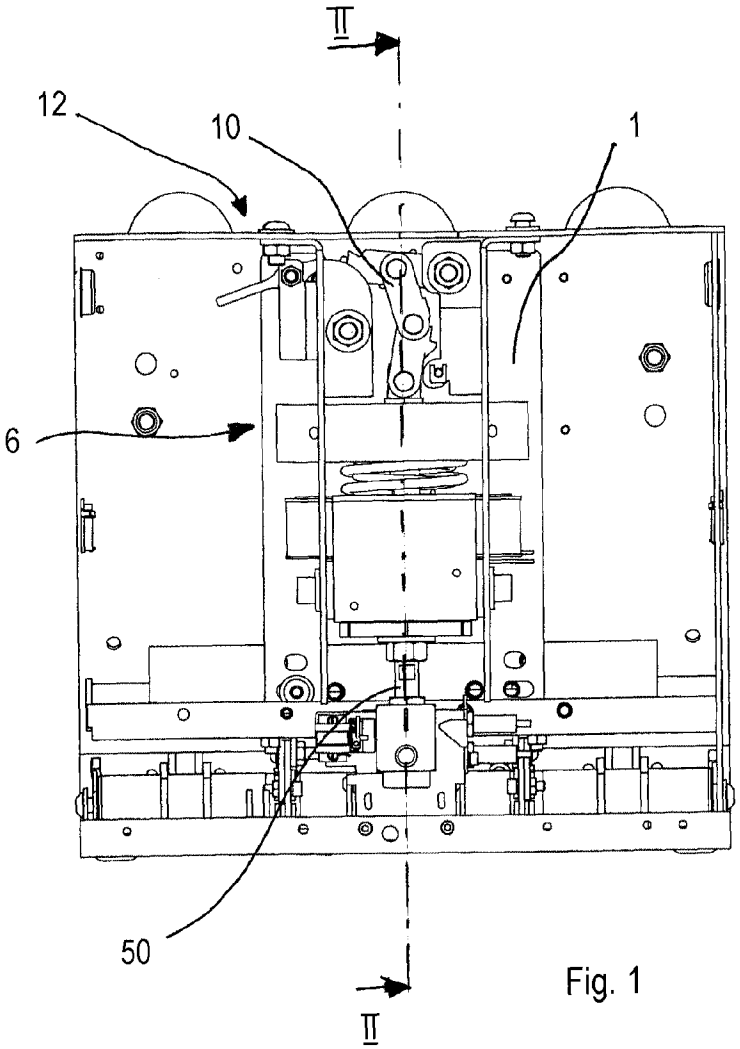
FIG. 1 shows a magnetic actuating device according to the invention in a released configuration.

With reference to the attached Figures, a magnetic actuating device 1 is shown, which is suitable for being connected to a current switching device 2 for switching on/off an electrical apparatus, for example an asynchronous three-phase apparatus. The magnetic actuating device 1 is particularly used in connection with a circuit breaker 2, having one or more poles, included in a switchgear. In the following non-limitative example, reference is made to a circuit breaker 2 having three poles 30, (e.g. gas pressurized poles, vacuum poles or others), each pole 30 having a fixed contact 31 and a movable contact 32. The three movable contacts 32 are connected to a oscillating-crank mechanism 33 which is reciprocatingly driven by the magnetic actuating device 1 of the invention so as to put the three poles in the closing or opening status.

The magnetic actuating device 1 comprises a ferromagnetic stator 3 and a ferromagnetic armature element 4 which is movable between a first end position 5, which is close to said ferromagnetic stator 3, and a second end position 6 which is spaced apart from the ferromagnetic stator 3.

In particular, an electrical closing status of the circuit breaker 2 corresponds to the first end position 5 of the ferromagnetic armature element 4. Conversely, an electrical opening status of the circuit breaker 2 corresponds to the second end position 6 of the ferromagnetic armature element 4.

The magnetic actuating device 1 comprises elastic means 7, in particular a compression spring 7 configured for urging the ferromagnetic armature element 4 to the second end position 6, as shown in FIGS. 1 to 4, and an electrical coil 8 which can be energized in order to electromagnetically attract the ferromagnetic armature 4 towards the first end position 5, thus closing the circuit breaker 2.

The magnetic actuating device 1 comprises a mechanical locking assembly 10 configured for releasably blocking the ferromagnetic armature 4 in the first end position 5 for keeping the circuit breaker 2 stable in the electrical closing status, as shown in FIGS. 5 to 8. The magnetic actuating device, differently from the prior art magnetic actuator, comprises the mechanical locking assembly 10 instead of permanent magnets.

The function of blocking the ferromagnetic armature 4 in the first end position 5, for keeping the circuit breaker 2 in the closed position, is carried out by the mechanical locking assembly 10 which replaces the prior art permanent magnets of the known actuators.

The mechanical locking assembly 10, as described in detail in the following, is operable between a locking configuration 11, shown in FIGS. 11 and 12, in which it is able to keep the ferromagnetic armature 4 blocked in the first end position 5 even while the electrical coil 8 is not energized, and a release configuration 12 in which the ferromagnetic armature 4 is free to move to the second end position 6 under the action of the compression spring 7.

The mechanical locking assembly comprise articulated-levers means 10 operatively connected to the ferromagnetic armature 4. The articulated-levers means 10 comprise rod lever means 13, 14 which are pivotally connected to, and are displaceable along with, a plunger 50 integral with the ferromagnetic armature 4, and rocking lever means 15, 16, 17 which are rotatable around stationary pivot means 18, 19, 20.

Figure 4:
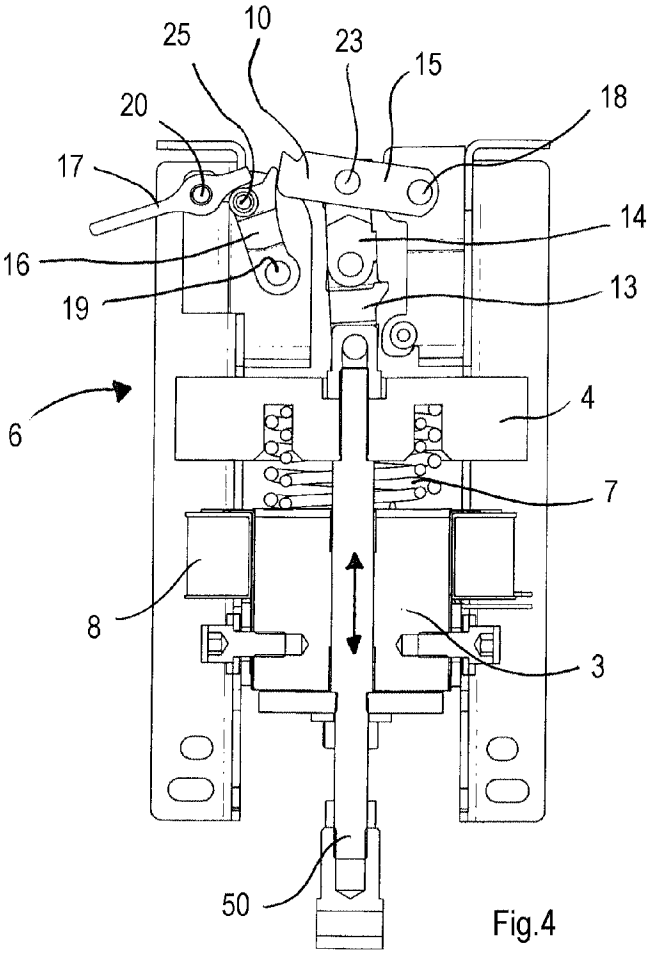
FIG. 4 is a section view of FIG. 3 taken along the plane IV-IV.
Figure 3:
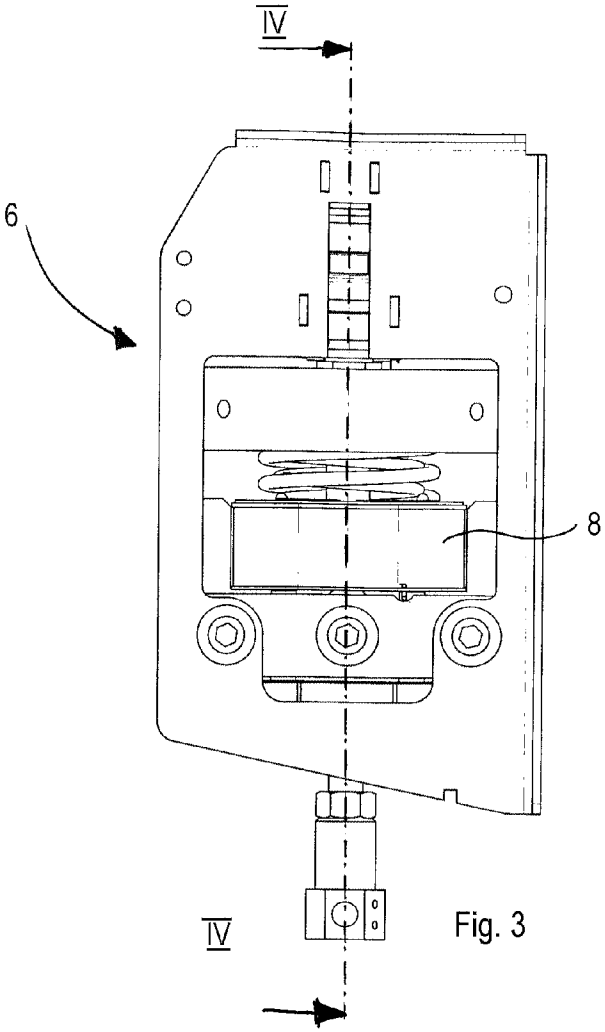
FIG. 3 is an enlarged view of the actuating device in the release configuration.
Figure 6:
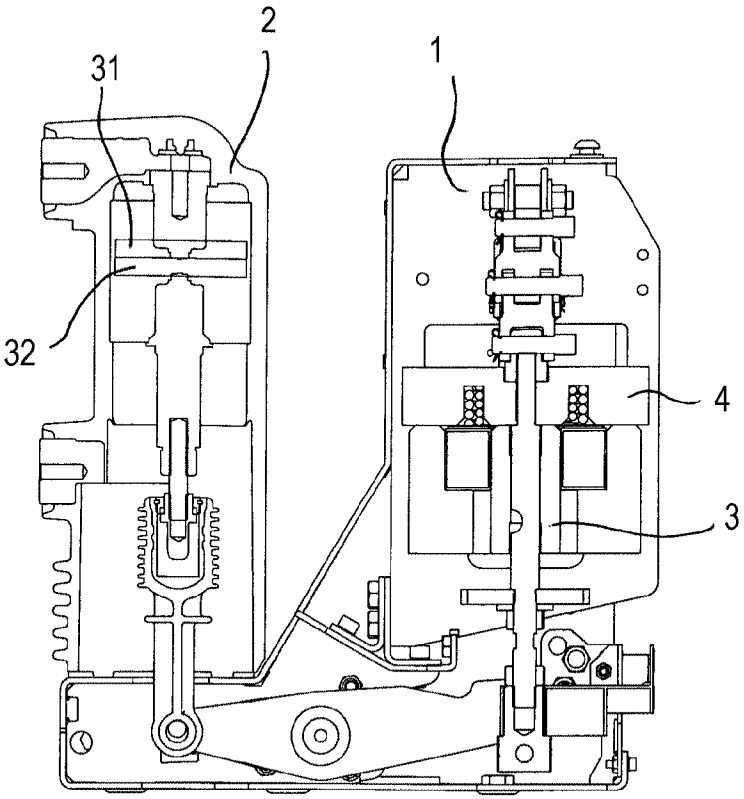
FIG. 6 is a section view of FIG. 5 taken along the plane VI-VI.
Figure 5:
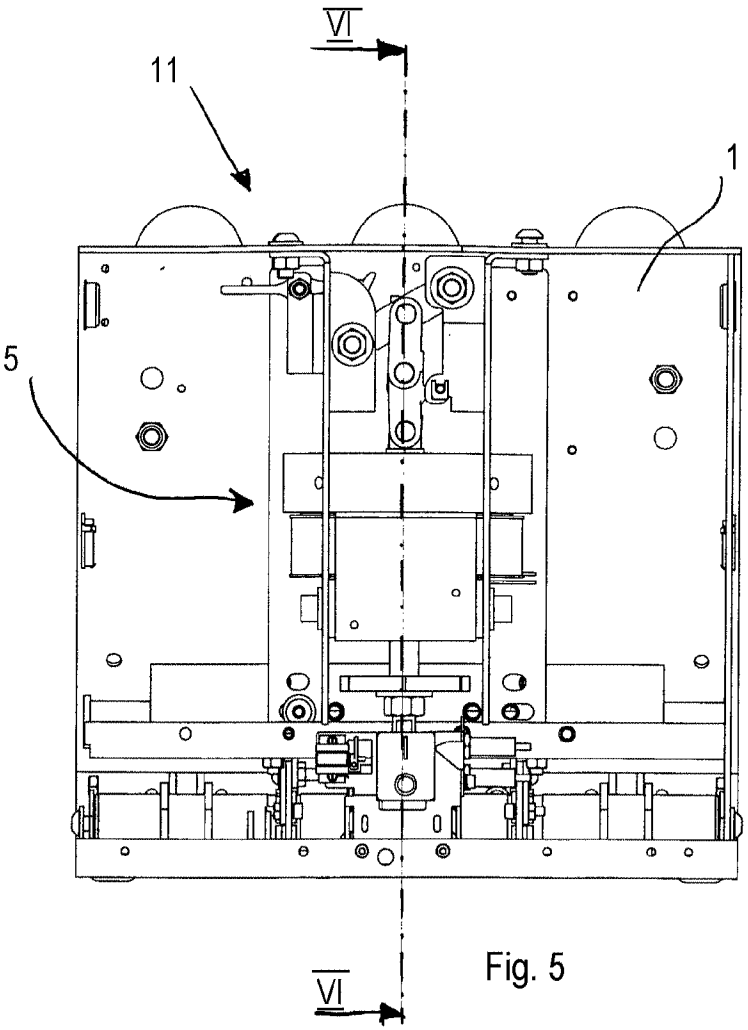
FIG. 5 shows the magnetic actuating device according to the invention in a locked configuration.

In particular, with reference to FIG. 4, the rod lever means comprise a first rod-lever 13 having a first end hinged to a respective end of the plunger 50, and a second rod-lever 14, hinged to a second end of the first rod-lever 13. The rocking lever means comprise a transom-rocking-lever 15, hinged to a first stationary pivot 18 and pivotally connected to the second rod-lever 14, and a latching-rocking-lever 16, hinged to a second stationary pivot 19 and releasably connectable to the transom-rocking-lever 15. The transom-rocking-lever 15 is transversely arranged with respect to a moving-direction of the ferromagnetic armature 4.

Figure 8:
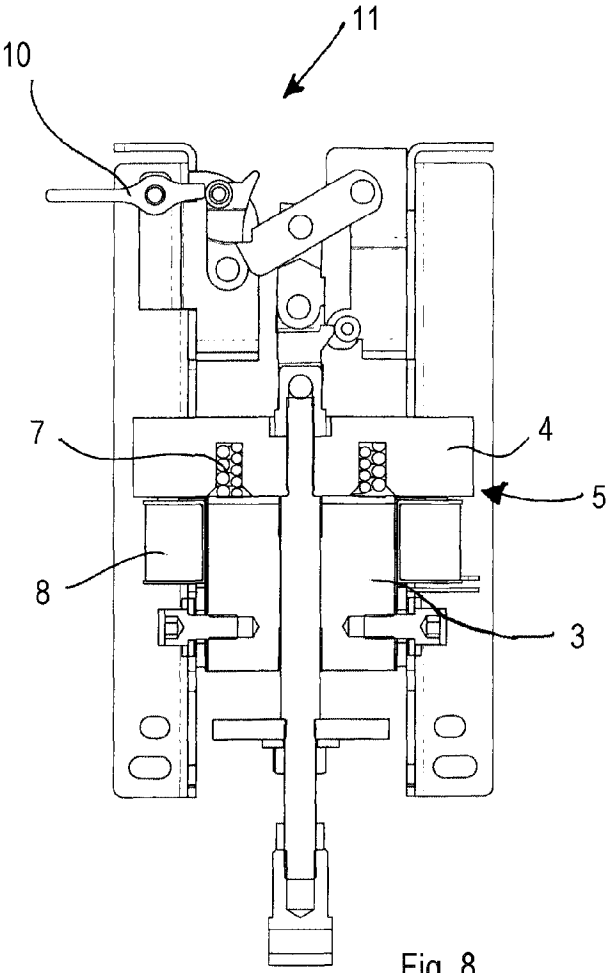
FIG. 8 is a section view of FIG. 7 taken along the plane VIII-VIII.
Figure 7:
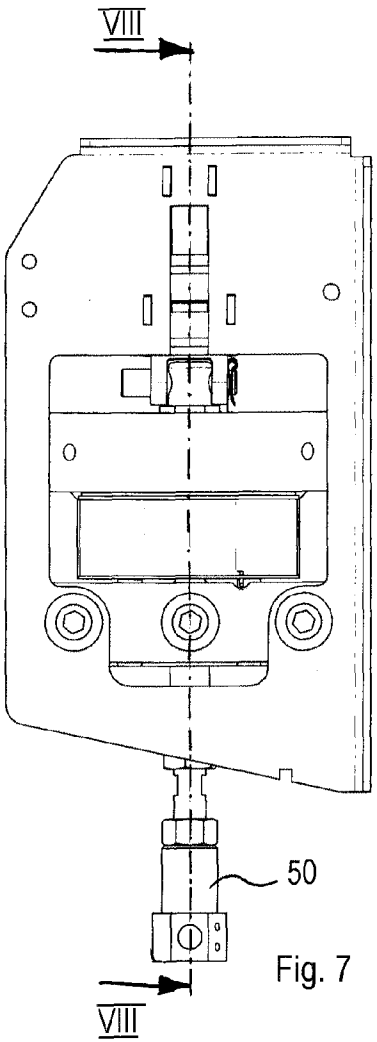
FIG. 7 is an enlarged view of the actuating device in the locking configuration.
Figure 11:
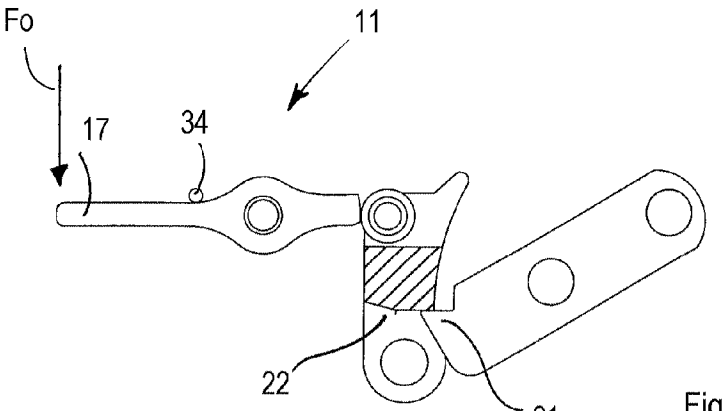
FIGS. 11 and 12 are a section view and a perspective view respectively of the mechanical locking assembly in the locked configuration.

The rocking lever means further comprise a release-lever 17 which is hinged to a third stationary pivot 20 and whose function is to prevent, in the locking configuration 11, a rotation of the latching-rocking-lever 16, as shown in FIGS. 8 and 11.

The transom-rocking-lever 15 comprises a hooking-end 21 which is adapted to couple with a hooking-recess 22 of the latching-rocking-lever 16 in a hooked-coupled-position when the ferromagnetic armature element 4 is positioned in the first end position 5.

Figure 12:
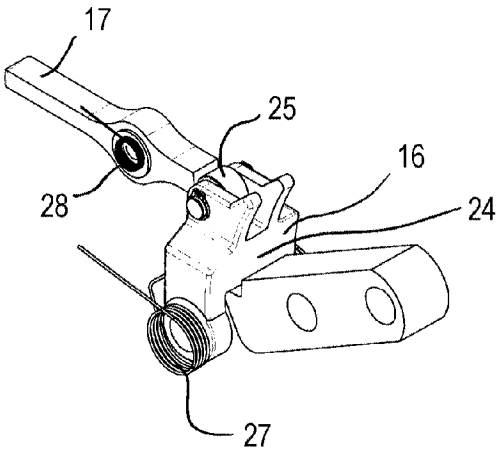
Figure 9:
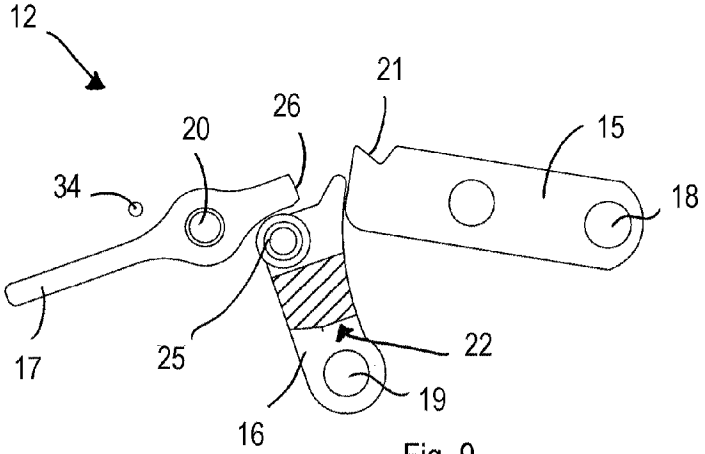
FIGS. 9 and 10 are a section view and a perspective view respectively of a mechanical locking assembly of the magnetic-actuating device in the released configuration.
Figure 10:
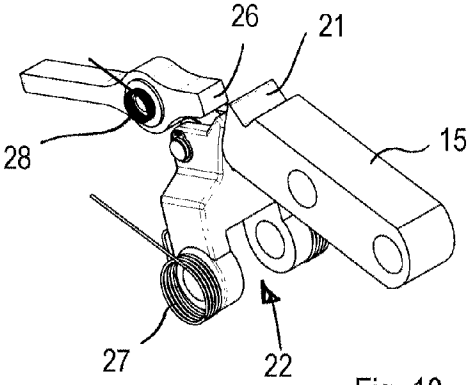

The latching-rocking-lever 16 is rotatable from an engaging position, visible in FIGS. 8, 11 and 12, in which the hooking-end 21 and the hooking-recess 22 are mutually arranged in the hooked-coupled-position, and the disengaging position, shown in FIGS. 4, 9, 10, in which the latching-rocking-lever 16 enables the hooking-end 21 to be released from the hooking-recess 22 thus enabling a rotation of the transom-rocking-lever 15 which is pushed by the a displacement of the ferromagnetic armature 4 to the second end position 6 due to the biasing force of the compression spring 7. A torsional spring 27, placed at the second stationary pivot 19, urges the latching-rocking-lever 16 towards the transom-rocking-lever 15. A high urging force by the torsional spring 27 is not necessary; the only task of the torsional spring 27 is to bias the latching-rocking-lever 16 towards the transom-rocking-lever 15 and no other load has to be contrasted.

Other equivalent return elastic means, instead of the torsional spring 27, can be provided for urging the latching-rocking-lever 16.

The second rod-lever 14 is pivotally connected to an intermediate hinge-zone 23 of the transom-rocking-lever 15 between the hooking-end 21 and the first stationary pivot 18.

The transom-rocking-lever 15 is adapted for exerting on the latching-rocking-lever 16, when in the hooked-coupled-position, a pushing-force FT' having a lever-arm B relative to the second stationary pivot 19. Such a pushing-force FT' acts for rotatably urging the latching-rocking-lever 16 towards the disengaging position. However, in the locking configuration 11, such a rotation is prevented by the release lever 17 which blocks the latching-rocking-lever 16 engaged with the transom-rocking-lever 15, unless an external release command is impressed on the release lever 17, as described in the following. A respective return elastic element 28, such as a torsional spring 28 or other equivalent means, urges the release-lever 17 in the locking configuration 11. A suitable stop protrusion 34 is provided for limiting the pivotal stroke of the release-lever 17 in the locking configuration 11.

The latching-rocking-lever 16 comprises a resting-roll-element 25 through which it rests against a locking-surface 26 of the release lever 17 in the locking configuration 11.

In the following, functioning of the magnetic actuating device 1 is described, starting from an electrical opened status of the circuit breaker 2, with reference to FIGS. 2 to 4, and FIGS. 9 and 10. In this condition, the ferromagnetic armature 4 is in the second end position 6, under the action of the compression spring 7, and the latching-rocking-lever 16, subjected to the action of the torsional spring 27, rests against an end surface of the transom-rocking-lever 15. A portion of the release lever 17 rests on the resting-roll-element 25.

When the circuit breaker 2 has to be closed, the electrical coil 8 is energized thus generating a magnetic field which attracts the ferromagnetic armature 4 to the first end position 5. The plunger 50, moving together with the ferromagnetic armature 4, pulls the first 13 rod lever and the second rod lever 14, which in turn drag and rotate the transom-rocking-lever 15. In a version, the first 13 rod lever and the second rod lever 14 can be replaced by a suitable single-piece rod-lever.

The transom-rocking-lever 15 is rotated as to bring the hooking-end 21 close to the hooking recess 22. During approaching of the transom-rocking-lever 15 to the second pivot 19, the hooking end 21 slides on a side curved surface of the latching-rocking-lever 16 while keeping the latter in the disengaged position. As the hooking end 21 reaches the hooking recess 22, the latching-rocking-lever 16 snaps and rotates towards the hinge zone 23. In this way, the hooked coupled position is reached by the hooking end 21 which is received in the hooking recess 22. At the same time, the release lever 17, under the action of the second torsional spring 28, rotates so that the locking surface 26, better shown in FIGS. 9 and 10, gets positioned on the resting-roll-element 25. The release lever 17 in this position keeps the latching-rocking-lever 16 firmly engaged with the transom-rocking lever 15 contrasting the force exerted by the compression spring 7 which is in a compressed status.

In the locking configuration 11, a force $F_{T''}$, which is exerted by the resting-roll-element 25 on the locking surface 26 of the release-lever 17, is applied along an application direction which intercepts, or extends very close to, the rotation axis of the third stationary pivot 20.

Owing to this configuration, a urging force by the torsional spring 28 is not required to be high. Therefore, a torsional spring 28 of small dimensions is sufficient for biasing the release-lever 17.

The function of holding the ferromagnetic armature 4 in the first end position 5 in a stable way, and thus the circuit breaker 2 in the closing status, is ensured by the mechanical locking assembly 10 instead of permanent magnets as occurs in the prior art actuators.

From what above described, it is evident that the mechanical locking assembly 10 automatically reaches the locking configuration 11 upon a movement of the ferromagnetic armature 4 towards the first end position 5.

When an electrical opening of the circuit breaker 2 is required, it is sufficient to apply on the release-lever 17 a light release-command force $F_o$ which rotates it so as to move away the locking surface 26 from the resting-roll-element 25, thus reaching a release position. In particular, with reference to the FIGS. 9 to 12, the force $F_o$ is directed downwards and the locking surface 26 is raised upwards, by sliding on the resting-roll-element 25. As the locking surface 26 leaves the resting-roll-element 25, the latching-rocking lever 16 is free to pivotally snap in a direction away from the transom-rocking lever 15 due to the pushing-force $F_{T'}$ exerted by the hooking end 21. The pushing-force $F_{T'}$, having the lever-arm B with respect to the second stationary pivot 19, causes a rotation of the latching-rocking lever 16 towards the third stationary pivot 20, and releases the transom-rocking lever 15.

Therefore, a movement of the transom-rocking-lever 15 upwards is triggered owing to the elastic energy stored in the compression spring 7 being in the compressed condition. The ferromagnetic armature 4 shifts to the second end position 6 and the oscillating crank mechanism 33 separates the movable contacts 32 from the respective fixed contacts 31.

A very small amount of energy is sufficient for unlocking the mechanical locking assembly 10 by acting on the release lever 17. The release-command-force $F_o$ may be exerted by a small solenoid or other equivalent driving element or even manually, if desired.

Figure 14:
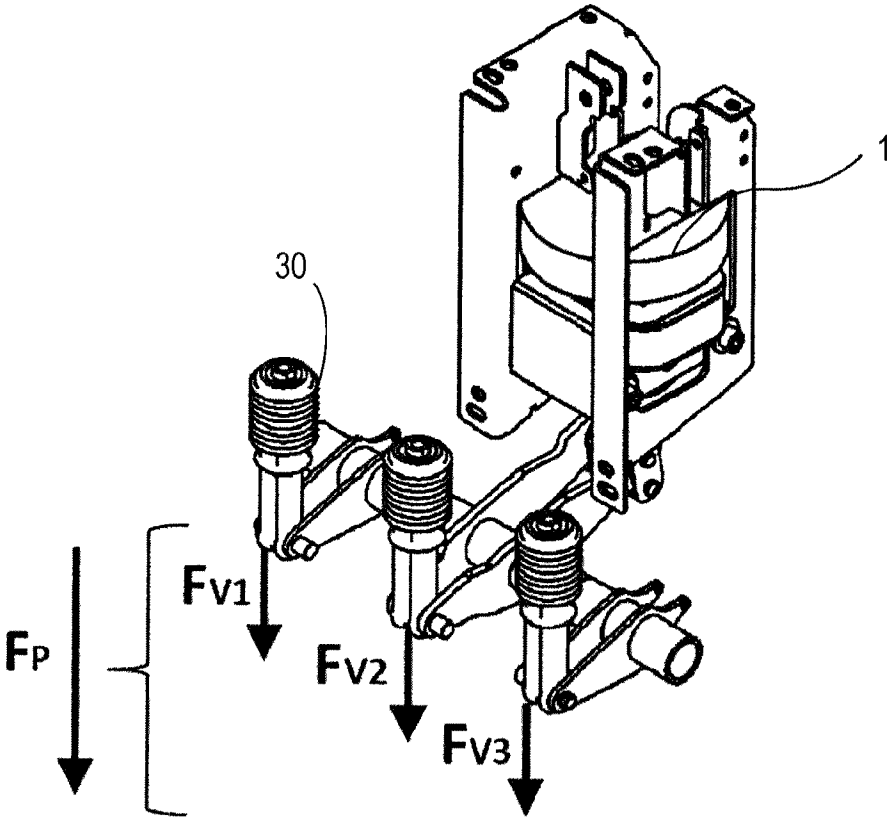
FIGS. 13 to 15 show, from different perspectives, the magnetic actuating device connected to three poles of a circuit breaker.
Figure 13:
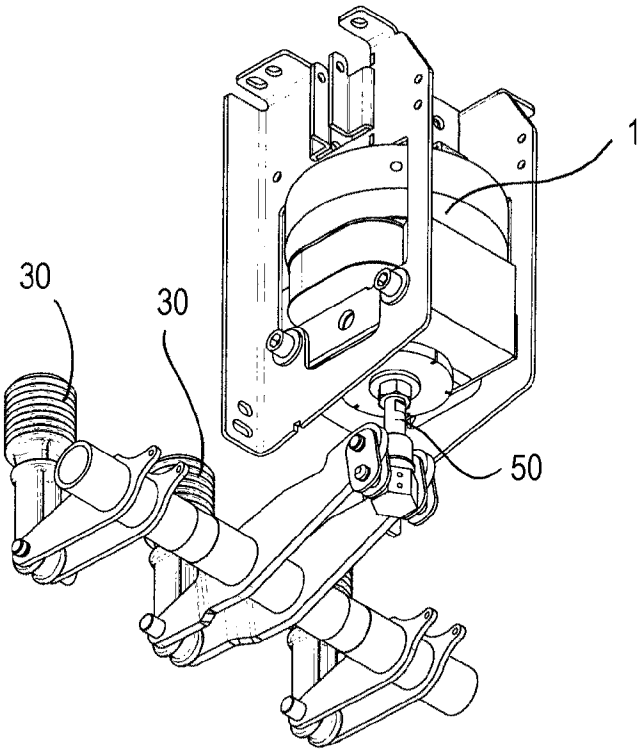
Figure 16:
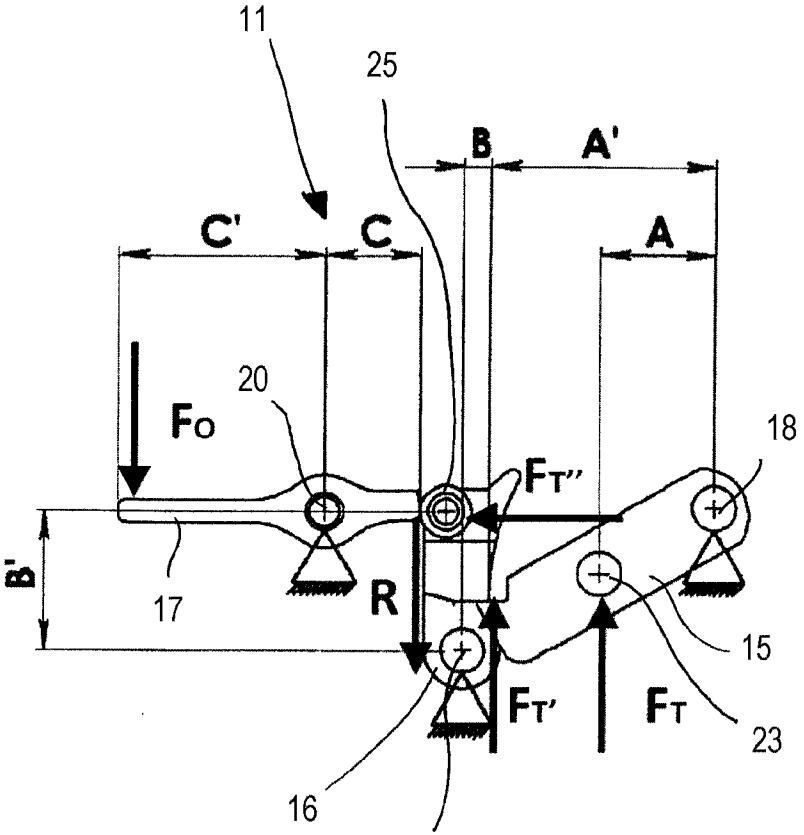
FIG. 16 shows schematically a set of forces acting on a part of the magnetic actuating device in the locking configuration.
Figure 15:
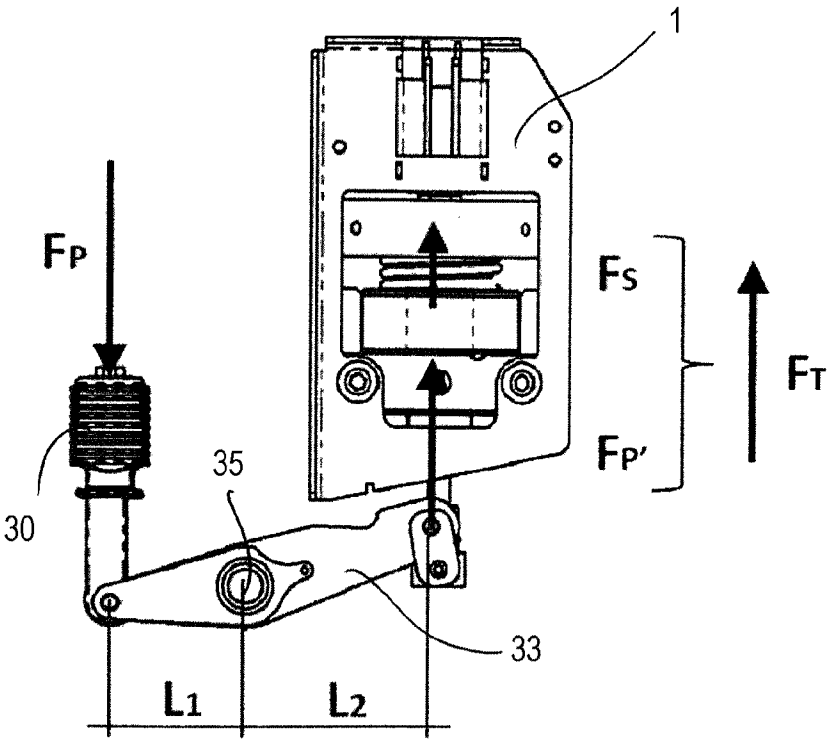

A following simplified scheme shown in FIGS. 14 to 16 along with a numerical example are useful to highlight the order of magnitude of the forces that are involved during operating of the mechanical locking assembly 10.

In the exemplary non limitative configuration with a three-phase circuit breaker 2 shown in FIG. 14, the total force of the poles to be overcome for closing the circuit breaker 2 is given by the sum of the three pole loads $F_{v1}$, $F_{v2}$, $F_{v3}$. Assuming that the three pole loads are equal to one other, i.e. $F_{v1}=F_{v2}=F_{v3}$, the total force of the poles amounts to:

$$F_P=3F_{v1}$$

With reference to FIG. 15, to balance the total force $F_P$, the force $F_{P'}$ exerted by the magnetic actuating device 1, in particular by the plunger 50, is:

$$F_{P'}=F_P*L_1/L_2$$

where L1 and L are lever arms respectively of the poles and of the plunger 50 with respect to a fulcrum 35 of the oscillating crank mechanism 33.

Furthermore, the compression spring 7 opposes a force $F_s$, therefore the total force $F_T$ to win is $$F_T=F_{P'}+F_s$$

The electrical coil 8 is appropriately dimensioned so that the magnetic circuit generated thereby is able to provide a force greater than $F_T$ so as to overcome also any mechanical inertia and frictions.

In the locking configuration 11, with reference to FIG. 16 and according to a simplified calculation which overlooks the biasing actions of the torsional springs 27, 28 and the frictions occurring at the stationary pivots 18, 19, 20, the following forces act on the mechanical locking assembly 10:

$$F_{T'}=F_T*A/A'$$

$$F_{T''}=F_{T'}*B/B'$$

$$R=F_{T''}*u/r$$

where A refers to a lever arm of the force $F_T$ acting on the hinge zone 23 with respect to the first pivot 18, A' indicates a lever arm with respect to the first pivot 18 of the force $F_{T'}$ exerted by the hooking end 21 on the hooking recess 22, B indicates a lever arm of the force $F_{T'}$ with respect to the second pivot 19 and B' refers to a lever arm with respect to the second pivot 19 of a force $F_{T''}$ exerted by the resting-roll-element 25 on the release-lever 17. Furthermore, R indicates a rolling friction which is exerted by the resting-roll-element 25, having a radius "r'", on the release lever 17. The reference "u" indicates a rolling friction parameter.

To perform the opening operation it is necessary to apply on the release lever 17 a release -command-force $F_o$ which is given by:

$$F_o=R*C/C'$$

where C and C' are lever arms relative to the third pivot 20 of the rolling friction R and of the release-command-force $F_o$ respectively.

Assuming to have by way of example the following data:

$F_{v1}=F_{v2}=F_{v3}=3000$ N (Newton)

$L_2=1.5*L_1$ $F_s=700$ N

A'=2*A

B'=5*B

C'=2*A r=14 mm u=0.01 mm

With these data it is found that:

$F_P=3F_{v1}=9000$N $F_{P'}=F_P*L_1/L_2=F_P/1.5=6000$ N $F_T=F_{P'}+F_s=6000+700=6700$ N and $F_{T'}=F_T*A/A'=F_T/2=6700/2=3350$ N $F_{T''}=F_{T'}*B/B'=F_{T'}/5=3350/5=670$ N $R=F_{T''}*u/r=670*0.01/14=0.5$ N and finally:

$F_o=R*C/C'=R/2=0.5/2=0.25$ N

Therefore, in comparison with the total force $F_T$ of 6700 N which is stably and successfully won by the mechanical locking assembly 10 in the locking configuration 11, it is sufficient a very small release-command-force $F_o$ amounting to 0.25 N for unlocking the magnetic actuating device 1 and thus opening the circuit breaker 2 in a simple and reliable manner. It is evident that such a small release-command-force $F_o$ can be produced with a very small electromagnetic solenoid with a noticeably reduced consumption of energy stored in suitable electrolytic capacitors. Even more, in the remote event that the very small energy required for the opening operation is not available, the magnetic actuating device 1 may be easily unlocked by intervening manually on the release lever 17, through the application of a very small force thereto. Naturally, instead of the electromagnetic solenoid, other suitable means can be provided, such as a small electric motor, a hydraulic or pneumatic actuator ecc.

It has been described how, owing to the magnetic actuating device 1 according to the invention, an electrical opening operation of a circuit breaker can be carried out in a reliable way and with a very reduced energy-consumption, thus overcoming the drawback of prior art actuators having permanent magnets. In particular, the risk of a prevented opening of the circuit breaker due to an insufficient residual charge stored in the capacitors is overcome by the magnetic actuating device 1 of the invention which, as above described, requires for the opening a very small force which can be produced by a small solenoid or even manually in case of emergency.

The magnetic actuating device 1 of the invention proves to be very reliable and cheaper than the prior art actuators, because of the absence of permanent magnets which, as it is known, are rather expensive.

The magnetic actuating device 1 without permanent magnets is susceptible of modifications or variations all within the scope of the inventive concept as defined by the appended claims.

Any details may be replaced with technically equivalent elements, and one or more of the elements above described may be differently shaped and/or positioned, can be realized in one or more pieces or differently coupled or positioned, etcetera.

In practice, the materials, so long as they are compatible with the specific use, as well as the individual components, may be any according to the requirements and the state of the art.

The invention claim is:

1. Magnetic actuating device for a current switching device comprising:

ferromagnetic stator means and a ferromagnetic armature element which is movable between a first end position, which is close to said ferromagnetic stator means, and a second end position which is spaced apart from said ferromagnetic stator means, elastic means directly engaged with said ferromagnetic armature element and configured for urging said ferromagnetic armature element to said second end position, electrical coil means energizable for electromagnetically attracting said ferromagnetic armature element to said first end position, and a mechanical locking assembly comprising articulated-levers means operatively connected to said ferromagnetic armature element, wherein said articulated-levers means comprise rod-lever means which are pivotally connected to, and displaceable along with, a plunger of said ferromagnetic armature element, and rocking-lever means associated with the rod-lever means, said rocking-lever means being rotatable around stationary pivot means and configured for releasably locking, thereby blocking said ferromagnetic armature element in said first end position, and wherein said rod-lever means comprise a first rod-lever having a first end hinged to a respective end of said plunger, and a second rod-lever hinged to a second end of said first rod-lever and wherein said rocking lever means comprise a transom-rocking-lever hinged to a first stationary pivot and pivotally connected to said second rod-lever and a latching-rocking-lever hinged to a second stationary pivot and releasably connectable to said transom-rocking-lever, said rocking-lever means further comprising a release-lever hinged to a third stationary pivot and configured for preventing, in said locking configuration, a rotation of said latching-rocking-lever.

2. Magnetic actuating device according to claim 1, wherein said mechanical locking assembly is operable between a locking configuration, in which said mechanical locking assembly is able to keep said ferromagnetic armature element blocked in said first end position even with said electrical coil means being in a denergized status, and a release configuration allowing said ferromagnetic armature element to move to said second end position.

3. Magnetic actuating device according to claim 2, wherein said mechanical locking assembly is configured for automatically reaching said locking configuration upon a movement of said ferromagnetic armature element to said first end position.

4. Magnetic actuating device for a current switching device comprising:

ferromagnetic stator means and a ferromagnetic armature element which is movable between a first end position, which is close to said ferromagnetic stator means, and a second end position which is spaced apart from said ferromagnetic stator means, elastic means directly engaged with said ferromagnetic armature element and configured for urging said ferromagnetic armature element to said second end position, electrical coil means energizable for electromagnetically attracting said ferromagnetic armature element to said first end position, and a mechanical locking assembly comprising articulated-levers means operatively connected to said ferromagnetic armature element, wherein said articulated-levers means comprise rod-lever means which are pivotally connected to, and displaceable along with, a plunger of said ferromagnetic armature element, and rocking-lever means associated with the rod-lever means, said rocking-lever means being rotatable around stationary pivot means and configured for releasably locking, thereby blocking said ferromagnetic armature element in said first end position, and wherein said rod-lever means comprise a single-piece rod-lever having a first end hinged to a respective end of said plunger, and wherein said rocking lever means comprise a transom-rocking-lever hinged to a first stationary pivot and pivotally connected to a second end of said single-piece rod-lever, said rocking lever means further comprising a latching-rocking-lever hinged to a second stationary pivot and releasably connectable to said transom-rocking-lever, said rocking-lever means further comprising a release-lever hinged to a third stationary pivot and configured for preventing, in said locking configuration, a rotation of said latching-rocking-lever.

5. Magnetic actuating device according to claim 4, wherein said transom-rocking-lever comprises a hooking-end which is adapted to couple with a hooking-recess of said latching-rocking-lever when said ferromagnetic armature element is placed in said first end position.

6. Magnetic actuating device according to claim 5, wherein said latching-rocking-lever is rotatable from an engaging position, in which said hooking-end and said hooking-recess are mutually arranged in a hooked-coupled-position, and a disengaging position in which said latching-rocking-lever allows a release of said hooking-end from said hooking-recess thus enabling said transom-rocking-lever to rotate following a displacement of said ferromagnetic armature element to said second end position.

7. Magnetic actuating device according to claim 6, wherein said second rod-lever, or said single-piece rod-lever, is pivotally connected to an intermediate hinge-zone of said transom-rocking-lever between said hooking-end and said first stationary pivot, said transom-rocking-lever exerting on said latching-rocking-lever in said hooked-coupled-position a pushing-force ($F_{T'}$) having a lever-arm (B) relative to said second stationary pivot and rotatably urging said latching-rocking-lever towards said disengaging position.

8. Magnetic actuating device according to claim 7, wherein said latching-rocking-lever comprises a resting-roll-element through which said latching-rocking-lever rests against a locking-surface of said release lever in said locking configuration.

9. Magnetic actuating device according to claim 8, wherein said release lever is drivable, upon a release-command-force ($F_o$), to a release position enabling said resting-roll-element to roll on, and move away from said locking-surface, thus triggering a movement of said latching-rocking-lever, due to said pushing-force ($F_{T'}$), to said disengaging position and releasing said transom-rocking-lever.

10. Magnetic actuating device according to claims 6, further comprising return elastic means adapted to urge said latching-rocking-lever towards said engaging position and said release lever towards said locking configuration.

11. Magnetic actuating device according to claim 1, wherein said elastic means comprise a compression spring configured for urging said ferromagnetic armature element to said second end position, and said electrical coil means comprise a single electrical coil arranged around said ferromagnetic stator means.

12. Current switching device comprising one or more poles, each having a fixed contact and a movable contact, and a magnetic actuating device according to claim 1 for imparting to the movable contacts an electrical closing and opening movement.

13. Switchgear apparatus comprising a circuit-breaker and a magnetic actuating device according to claim 1 for opening/closing said circuit-breaker.

14. Current switching device comprising one or more poles, each having a fixed contact and a movable contact, and a magnetic actuating device according to claim 4 for imparting to the movable contacts and electrical closing and opening movement.

15. Switchgear apparatus comprising a circuit-breaker and a magnetic actuating device according to claim 4 for opening/closing circuit-breaker.

* * * * *